US005892206A

United States Patent [19]

Higgins

[11] Patent Number: 5,892,206

[45] Date of Patent: Apr. 6, 1999

[54] RADIANT ELECTRIC HEATER ARRANGEMENT AND METHOD OF OPERATING THE SAME

[75] Inventor: George Anthony Higgins, Stourbridge, United Kingdom

[73] Assignee: Ceramasdeed Limited, United Kingdom

[21] Appl. No.: 743,714

[22] Filed: Nov. 6, 1996

[30] Foreign Application Priority Data

Nov. 30, 1995 [GB] United Kingdom ..... 9524481

[51] Int. Cl.[6] ..... H05B 3/68

[52] U.S. Cl. ..... 219/466; 219/464; 219/465; 219/446

[58] Field of Search ..... 219/464, 465, 219/466, 441, 553, 449, 467, 497, 534

[56] References Cited

U.S. PATENT DOCUMENTS

| | | | |
|---|---|---|---|
| 3,912,905 | 10/1975 | Giler . | |
| 4,810,857 | 3/1989 | Goessler . | |
| 5,043,559 | 8/1991 | Scott | 219/464 |
| 5,171,973 | 12/1992 | Higgins . | |

FOREIGN PATENT DOCUMENTS

| | | |
|---|---|---|
| 0103741 | 3/1984 | European Pat. Off. . |
| 0233375 | 8/1987 | European Pat. Off. . |
| 3345991 | 6/1985 | Germany . |
| 3941186 | 6/1991 | Germany . |
| 783262 | 9/1957 | United Kingdom . |
| 816637 | 7/1959 | United Kingdom . |
| 2263379 | 1/1992 | United Kingdom . |

OTHER PUBLICATIONS

European Search Report.

*Primary Examiner*—Teresa J. Walberg
*Assistant Examiner*—Vinod D Patel
*Attorney, Agent, or Firm*—Ira S. Dorman

[57] ABSTRACT

A radiant electric heater arrangement for a glass-ceramic top cooking appliance includes a heater in the form of a dish-like support supporting a first heating element and a second heating element. The first heating element has a predetermined minimum operating life expectancy at a predetermined optimum operating temperature. During user-selectable periods of boost heating the first heating element is connected independently to a voltage supply and operates at a first temperature higher than the predetermined optimum operating temperature. In contrast, during user-selectable periods of normal heating, the second heating element is connected to the voltage supply in series with the first heating element, the first heating element operating at a second temperature lower than the predetermined optimum operating temperature.

40 Claims, 3 Drawing Sheets

FIG 2
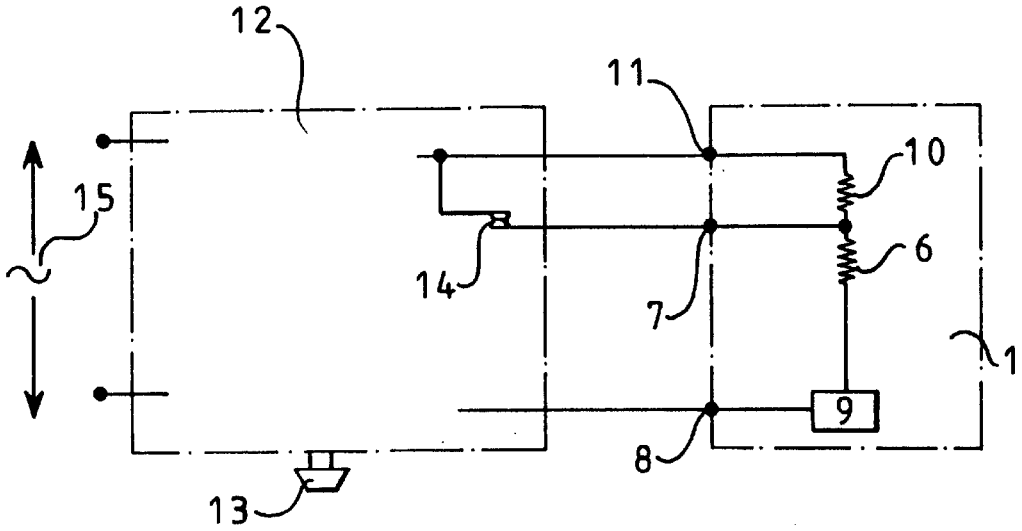
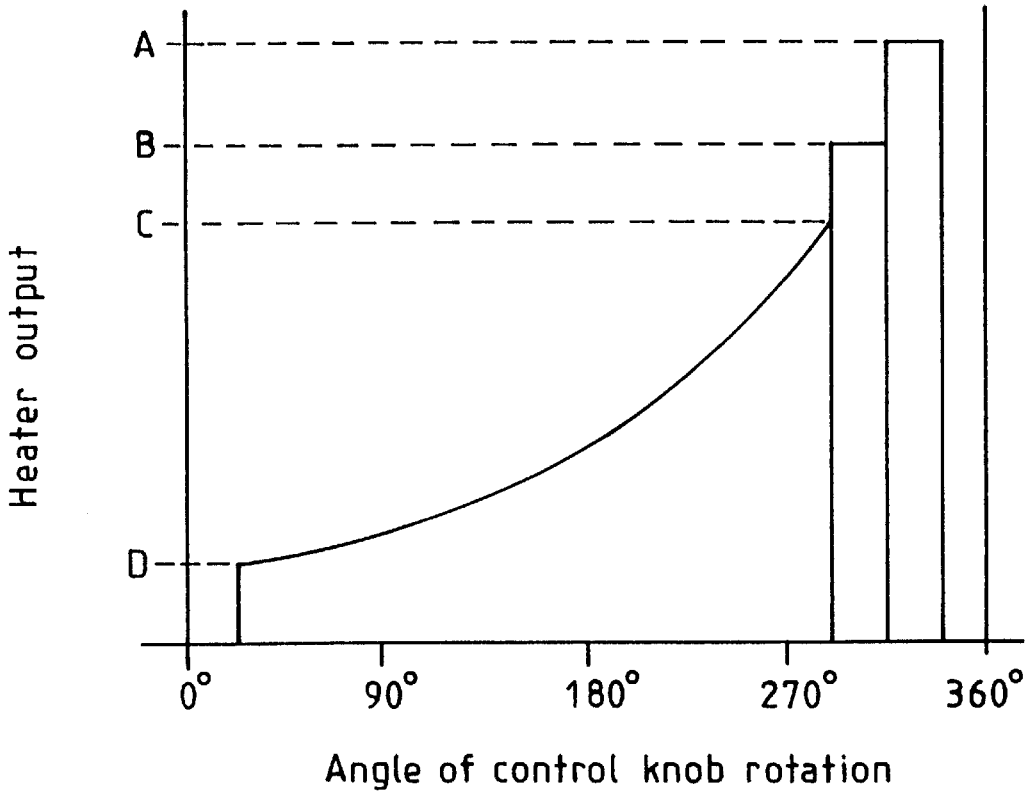
FIG 3

RADIANT ELECTRIC HEATER ARRANGEMENT AND METHOD OF OPERATING THE SAME

This invention relates to a radiant electric heater arrangement for a glass-ceramic top cooking appliance and to a method of operating such a radiant electric heater arrangement.

BACKGROUND TO THE INVENTION

Glass-ceramic top cooking appliances incorporating radiant electric heaters have been known for many years. Throughout their period of development there has been an ongoing demand to reduce the heat-up time to radiance of heating elements in heaters used therein, when such heaters are energised.

A particularly fast heat-up time has been achieved with the use of tungsten-halogen lamps as heating elements, but such lamps are expensive.

Particular attention has therefore been given to the ongoing development of heaters incorporating bare metallic heating elements in the form of coiled wire or, more recently, corrugated metal ribbon. With such elements, oxidation of the components thereof occurs during operation thereof and the rate of such oxidation increases with increasing operating temperature. After prolonged periods of operation, failure of the elements occurs.

The use of a material such as iron-chromium-aluminium alloy for heater elements has led to the provision of heaters with good operating life expectancy of at least 2500 hours, as a result of the formation of a protective layer of aluminium oxide on the surface of the elements. However, even with the use of such a material care has to be taken to limit the operating temperature of the elements in order to achieve satisfactory operating life. It has been found, for example, that in the case of a corrugated ribbon heating element an increase in operating temperature by about 30° C. at temperatures of about 1000° C. can result in the life of the element being approximately halved.

For this reason, heaters are generally designed such that the element or elements therein operate in service at a temperature which will provide a predetermined operating life expectancy for the heater before failure of the element or elements occurs. Such operating temperature in service will be referred to in this specification as the predetermined optimum operating temperature of the element or elements which may, for example, be between about 960° C. and about 1020° C. for a typical corrugated ribbon element and between about 950° C. and about 1150° C. for a typical coiled wire element, according to the specific material, geometry and power of the ribbon or wire element, and may be selected, for example, to provide a predetermined operating life expectancy of 2500 hours or more.

It is particularly desirable to provide a heater in which the heat-up time to radiance is as short as possible and the temperature of the element or elements is as high as possible at least during an initial period, for example in order to promote rapid boiling of the contents of a cooking utensil placed on the glass-ceramic cook-top. Fast heat-up to radiance is also visually appealing to the user.

DESCRIPTION OF PRIOR ART

EP-A-0 250 880 describes a radiant electric heater for a glass-ceramic top cooking appliance, the heater incorporating radially inner and outer heating elements in which in an outer area of the heater, at least in an initial cooking phase, there is a higher radiation density than in an inner area. Where the end of the initial cooking phase is to be determined, this can be done in either a time-dependent manner or progressively, such that, during final cooking, the difference between the radiation density of the outer and inner areas is at least reduced. In this case, the initial cooking phase cannot be repeated until such time as the component responsible for determining the end of the initial cooking phase can be reset and as described in the reference this involves the component cooling below a predetermined temperature. Alternatively, the end of the initial cooking phase is not determined and the outer heating element remains energised in the state of providing a higher radiation density than the inner element. In this case, though, there is a serious risk due to the high operating temperature that the outer heating element will suffer an early failure with the result that the entire heater will need to be replaced at significant inconvenience and expense to the user.

OBJECT OF THE INVENTION

It is an object of the present invention to overcome or minimise these problems.

SUMMARY OF THE INVENTION

According to one aspect of the present invention there is provided a radiant electric heater arrangement for a glass-ceramic top cooking appliance, the arrangement including a heater comprising a dish-like support having supported therein a first heating element and a second heating element, wherein the first heating element has a predetermined minimum operating life expectancy at a predetermined optimum operating temperature;

means is provided to connect the first heating element independently to a voltage supply during user-selectable periods of boost heating in which the first heating element operates at a first temperature higher than the predetermined optimum operating temperature; and means is provided to connect the first heating element and the second heating element in series for energising from the voltage supply during user-selectable periods of normal heating, the second heating element being adapted and arranged such that, when connected in series with the first heating element, the first heating element operates at a second temperature lower than the predetermined optimum operating temperature.

According to another aspect of the present invention there is provided a method of operating a radiant electric heater arrangement for a glass-ceramic top cooking appliance, the arrangement including a heater comprising a dish-like support having supported therein a first heating element and a second heating element, the first heating element having a predetermined minimum operating life expectancy at a predetermined optimum operating temperature wherein during user-selectable periods of boost heating the first heating element is connected independently to a voltage supply and operates at a first temperature higher than the predetermined optimum operating temperature; and during user-selectable periods of normal heating, the second heating element is connected to the voltage supply in series with the first heating element, the first heating element operating at a second temperature lower than the predetermined optimum operating temperature.

The first temperature, the second temperature and the relative durations of the periods in which the first heating element is energised independently and in series with the second heating element can therefore be employed by the skilled person in order to ensure that the first heating element should have a life expectancy at least corresponding to the predetermined operating life expectancy.

In practice, the sum of the periods of boost heating is generally significantly less than the sum of the periods of normal heating.

It will be appreciated that in order to activate a period of boost heating, whether it be an initial period or a subsequent period, it is not necessary to turn the heater off until such time as a boost control component has cooled to a predetermined temperature. In accordance with the present invention, boost heating is available to the user at all times.

The second heating element may also have an operating temperature when connected in series with the first heating element to provide a predetermined operating life expectancy therefor, which is at least equal to that of the first heating element.

The second heating element may have an operating temperature which is substantially the same as the second temperature of the first heating element when operating connected in series therewith.

Suitably, the first heating element has substantially the same material composition and/or construction as the second heating element.

The first heating element and the second heating element may each comprise a bare metallic coiled wire resistance element or ribbon-form resistance element, the latter being preferably corrugated and supported edgewise in the dish-like support.

The first heating element and the second heating element may be permanently connected in series, with means being provided for short-circuiting the second heating element during user-selected periods of boost heating. In this regard, the first heating element and the second heating element may comprise separate elements permanently connected in series or may comprise a single element having a tapping point for electrical connection.

The first heating element may be arranged to occupy a major proportion of the area within the dish-like support, the second heating element occupying a minor proportion thereof.

Preferably the second heating element is arranged in a peripheral region of the dish-like support and may be arranged to substantially surround the first heating element.

The radiant electric heater arrangement may include a manually adjustable cyclic energy regulator connected to the heater and arranged for connection to the voltage supply, the first heating element being arranged for connection to the voltage supply independently of the second heating element in a full power setting of the cyclic energy regulator for selected periods of boost heating and the first heating element and the second heating element being connected in series and for connection to the voltage supply in other settings of the cyclic energy regulator, for selected periods of normal heating.

Preferably, in the full power setting of the cyclic energy regulator the first heating element is energised without cycling of the voltage supply.

In other settings of the cyclic energy regulator the first and second heating elements in series are cyclically energised from the voltage supply at selected duty cycles which preferably include 100 percent. For the sake of clarity, 100 percent duty cycle in this case means that the first and second heating elements, in series, are energised without cycling of the voltage supply.

Connection of the first heating element to the voltage supply in the full power setting of the cyclic energy regulator may be effected by short-circuiting the second heating element with the first and second heating elements connected in series with one another.

Such short-circuiting is suitably achieved by means of switch contacts in, or associated with, the cyclic energy regulator.

Manual adjustment of the cyclic energy regulator is preferably by means of a control knob rotatable by a user.

The full power setting of the cyclic energy regulator, for periods of boost heating, is preferably attainable directly from an 'OFF' setting of the cyclic energy regulator; however, such full power setting may alternatively or additionally be attainable by first passing through the other settings of the cyclic energy regulator.

In the case of a first heating element comprising a bare metallic ribbon resistance element, suitably of corrugated form, and suitably comprising an iron-chromium-aluminium alloy, secured by partial embedment in a base of thermal insulation material, preferably microporous insulation material, the predetermined optimum operating temperature may be from about 960° C. to about 1020° C.

During selected periods of boost heating, such a ribbon heating element may be arranged to operate at a temperature from about 1000° C. to about 1060° C.

During selected periods of normal heating, such a ribbon heating element may be arranged to operate at a temperature from about 920° C. to about 980°.

The predetermined minimum operating life expectancy for such a ribbon heating element may be at least about 2500 hours.

In the case of a first heating element comprising a bare metallic coiled wire resistance element and suitably comprising an iron-chromium-aluminium alloy, secured to a base of thermal insulation material, preferably microporous thermal insulation material, the predetermined optimum operating temperature may be from about 950° C. to about 1150° C.

During selected periods of boost heating, such a coiled wire heating element may be arranged to operate at a temperature from about 1000° C. to about 1200° C.

During selected periods of normal heating, such a coiled wire heating element may be arranged to operate at a temperature from about 900° C. to about 1100° C.

The predetermined minimum operating life expectancy for such a coiled wire heating element may be at least about 2500 hours.

The selected periods of boost heating may turn out, in practice, to be between about 10 percent and about 40 percent of the total period for which the energy regulator is in any 'ON' setting.

For a better understanding of the present invention and to show more clearly how it may be carried into effect reference will now be made, by way of example, to the accompanying drawings in which:

BRIEF DESCRIPTION OF THE DRAWINGS

FIG. 2 is a diagrammatic representation of a heater arrangement according to the invention, incorporating the heater of FIGS. 1A and 1B together with a cyclic energy regulator;

FIG. 3 is a graph showing the energy output of the heater arrangement of FIG. 2 as a function of angular position of a control knob of the cyclic energy regulator;

DESCRIPTION OF PREFERRED EMBODIMENTS

Figure 1A:
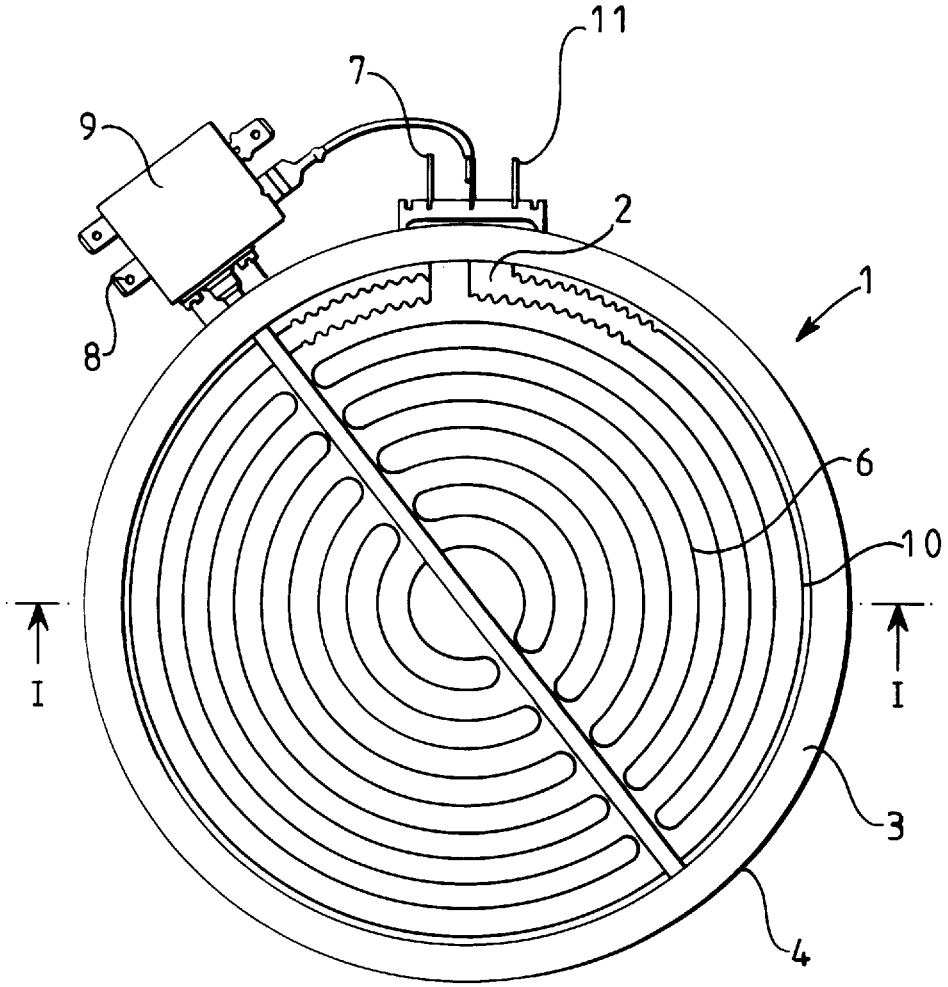
FIG. 1A is a plan view of an embodiment of a radiant electric heater for use in the arrangement of the present invention, the heater incorporating a corrugated ribbon heating element.
Figure 1B:
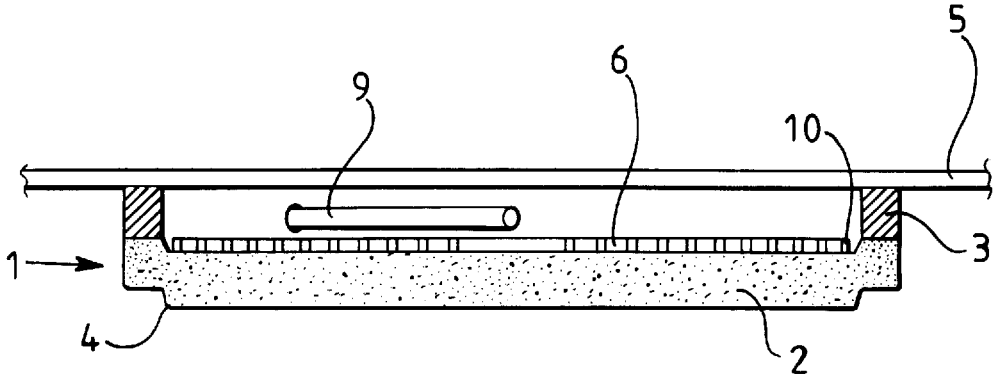
FIG. 1B is a cross-sectional view along line A—A of the heater of FIG. 1A.

As shown in FIGS. 1A and 1B, a radiant electric heater 1, for use in a glass-ceramic top cooking appliance, comprises a base layer 2 of thermal insulation material, such as microporous thermal insulation material, a peripheral wall 3 of thermal insulation material and a metal dish 4 supporting the base layer 2 and peripheral wall 3. The heater is arranged such that, when installed in a glass-ceramic top cooking appliance, the top surface of the peripheral wall 3 contacts the underside of the glass-ceramic cook top 5, as shown in FIG. 1B.

A first heating element 6 is provided, distributed over the majority of the area of the heater apart from a relatively small area around the periphery. The first heating element 6 comprises a bare metallic corrugated ribbon, for example of iron-chromium-aluminium alloy, supported on edge and secured by partial embedment in the base layer 2. The corrugated ribbon may be provided, in known manner, with integral tabs (not shown), coplanar therewith, extending from its lower edge and embedded in the base layer 2. By way of example, the ribbon material of the element 6 may be about 40 $\mu$m (microns) thick and about 5 mm in height. The ends of the first heating element 6 are connected to terminals 7 and 8 on the heater, the connection to terminal 8 being by way of a thermal limiter 9 which has a rod-like sensor extending across the heater and serves to electrically disconnect the heater from a power supply if, in use, the temperature of the glass-ceramic cook top 5 becomes too high.

A second heating element 10, also of bare metallic corrugated ribbon form, is provided, suitably as a single turn, surrounding the first heating element 6 and located between the first heating element 6 and the peripheral wall 3 of the heater. This second heating element 10 may be constructed and supported in the same way as the first heating element 6 and may be of the same, or similar, thickness and height of ribbon as the first heating element 6. One end of the second heating element 10 is connected to terminal 7 of the heater, in common with one end of the first heating element 6. The other end of the second heating element 10 is connected to a terminal 11 on the heater.

The first heating element 6 is constructed in such a way that if connected directly to a mains voltage supply by means of terminals 7 and 8, it would heat up rapidly to a temperature in excess of that which would be a predetermined optimum operating temperature for such a ribbon element to provide a required predetermined minimum operating life expectancy for the element. By way of example, the first heating element 6 is constructed such that when connected to a mains voltage supply of 230 volts it dissipates about 1800 watts and has an operating temperature of about 1050° C. The predetermined optimum operating temperature of the first heating element 6 in order to provide a required predetermined minimum life expectancy of about 2500 hours would be about 1010° C. Consequently, continuous operation at 1050° C. would seriously shorten the life of the element.

This problem is dealt with by arranging for the connection of the first heating element 6 directly to the mains voltage supply to be effected only during user-selected periods of boost heating, particularly for use during an initial cooking period to bring the contents of a cooking utensil rapidly up to boiling point. The associated fast heat-up of the first heating element 6 to brighter radiance than normal is also visually appealing to the user. Such user-selected periods of boost heating, although selectable at any time, will in total not normally be more than about 10 to 40 percent of the total period of energisation of the heater.

At all other periods of operation of the heater, that is user-selected periods of normal heating as distinct from the relatively short selected periods of boost heating, the first heating element 6 is electrically connected in series with the second heating element 10 such that the operating temperature of the first heating element 6 is reduced to a level which is less than the predetermined optimum operating temperature for the first heating element 6 and such that the operating life expectancy for the first heating element 6 substantially corresponds to the predetermined minimum operating life expectancy associated with the predetermined optimum operating temperature. This downward offset of the operating temperature of the first heating element 6, to below the predetermined optimum operating temperature during the user-selected periods of normal heating, is arranged to compensate for the amount by which the temperature of the first heating element 6 is above the predetermined optimum operating temperature during the relatively short user-selected periods of boost heating and results in a life expectancy for the first heating element 6 of substantially the order of that which would be obtained if the first heating element 6 were always operated at its predetermined optimum operating temperature.

In the present specific example, during the selected periods of boost heating the operating temperature of the first heating element 6 may be about 1050° C., compared with the predetermined optimum operating temperature of about 1010° C. During the selected periods of normal heating with the first heating element 6 and second heating element 10 in series, the operating temperature of the first heating element 6 may be arranged to be about 970° C.

During the selected periods of normal heating, the second heating element 10 may be arranged to operate at substantially the same temperature as the first heating element 6, although this is not essential.

The heater 1 may advantageously be operated in an arrangement with a cyclic energy regulator 12, as shown in FIG. 2. The connections to the heater from the regulator are denoted by reference numerals 7, 8, 11, as also shown in FIG. 1A.

The cyclic energy regulator is manually adjustable by a user by means of a rotatable control knob 13 to provide a range of power settings for the heater 1. The regulator may be continuously variably adjustable or stepwise adjustable, by design. The regulator 12 has therein, or associated therewith, a set of contacts 14 which, when open, provide for series connection of the first heating element 6 and second heating element 10, for selected periods of normal heating by the heater, the series combination of the first and second heating elements 6 and 10 being energisable from a voltage supply 15. When the contacts 14 of the regulator 12 are closed, the second heating element 10 is short-circuited, leaving only the first heating element 6 connected to the voltage supply 15 for user-selected periods of boost heating by the heater.

The cyclic energy regulator 12 is able to be adjusted to a full power setting, for the selected periods of boost heating, in two ways at any time. If the control knob 13 is rotated by the user from an 'OFF' position in one direction of rotation, the full power setting is obtained directly immediately adjacent to the 'OFF' position. If the control knob 13 is rotated from the 'OFF' position in the opposite direction of rotation, the full power setting is only obtained after passing through all lower power settings of the regulator. In the full power setting, regardless of how reached, the switch contacts 14 are closed, the second heating element 10 short-circuited and the supply voltage 15 is applied, without cycling, to the first heating element 6. For this selected period of boost heating a heater output of, for example, 1800 watts is obtained, as indicated by dotted line A in FIG. 3. On switching to this full power setting, the first heating element 6 heats up rapidly to its boost temperature of, for example, 1050° C.

If the control knob 13 of the regulator 12 is rotated by the user slightly from the full power setting in a direction other than directly to 'OFF', the switch contacts 14 of the regulator 12 open and the voltage supply 15 is then applied, without cycling, to the series combination of the first heating element 6 and the second heating element 10. In this setting, the heater output reduces to, for example 1500 watts as indicated by dotted line B in FIG. 3 and the temperature of the first heating element 6 reduces to a temperature for normal operation of, for example, 970° C., which temperature is suitably below the predetermined optimum operating temperature of the element for the reasons previously given.

If the control knob of the regulator is further rotated in the same direction, the switch contacts 14 remain open and the series combination of the first and second heating elements 6 and 10 is energised cyclically at selected duty cycles giving heater outputs of, for example, 85 percent of 1500 watts, as indicated by dotted line C in FIG. 3, down to 5 percent of 1500 watts, as indicated by dotted line D in FIG. 3. Further rotation of the knob 13 of the regulator 12 results in switching off of the heater.

The provision of a low heater output setting of, for example, 5 percent of 1500 watts, rather than 5 percent of the boost power of 1800 watts, is advantageous for achieving good low temperature performance for simmering in respect of the contents of a cooking utensil when heated by the heater.

The described sequence of operation may, of course, be carried out in reverse, starting from the 'OFF' position and up through the positions of increasing duty cycles to the uncycled 1500 watts position and then to the 1800 watts boost position.

Figure 4A:
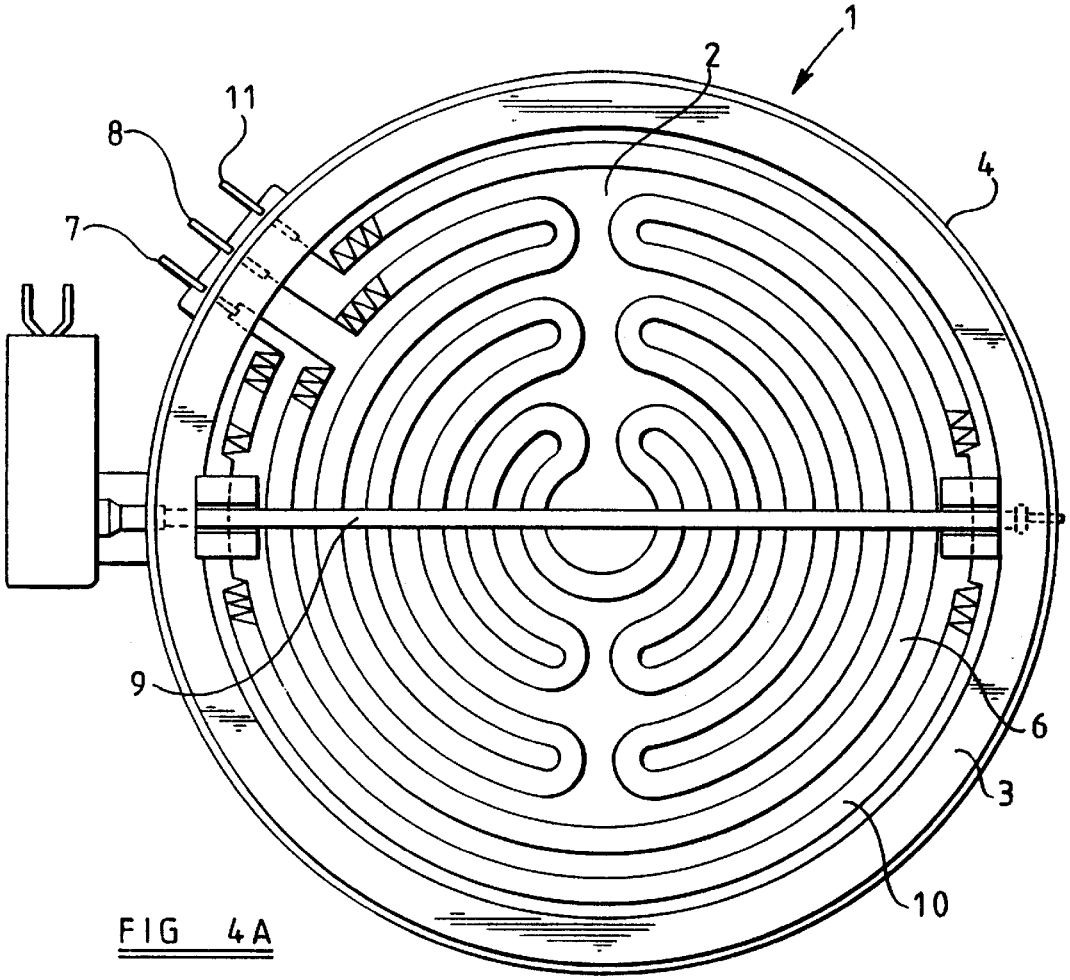
FIG. 4A is a plan view of an embodiment of a radiant electric heater for use in the arrangement of the present invention, the heater incorporating a coiled wire heating element.
Figure 4B:
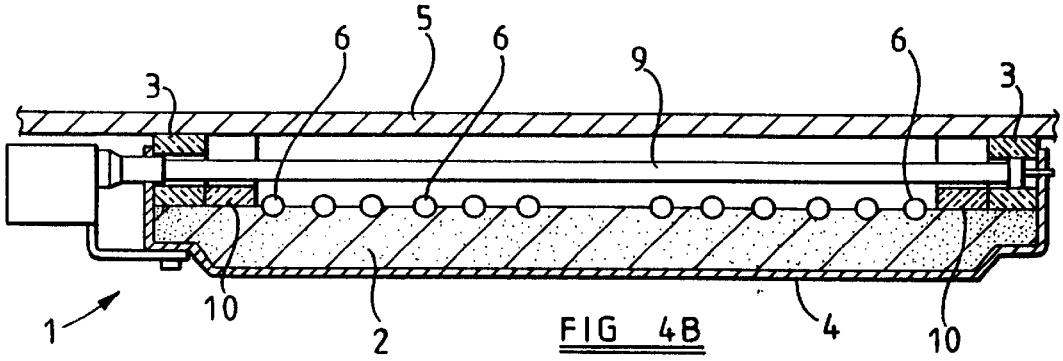
FIG. 4B is a cross-sectional view of the heater of FIG. 4A.

The radiant heater shown in FIGS. 4A and 4B is similar to that shown in FIGS. 1A and 1B and the same reference numerals are used to denote the same or similar components.

The radiant heater of FIGS. 4A and 4B differs from that of FIGS. 1A and 1B in that the first and second heating elements 6 and 10 are in the form of coiled wire elements. It should be noted that the two heating elements 6 and 10 can be in the form of a single element having a tapping point for electrical connection at the terminal 7.

The thermal limiter 9 is shielded from the second heating element 10 where the limiter passes over the second heating element. The shielding is effected by a block of thermal insulating material such as ceramic fibre material, the limiter passing through a groove formed in each block. Where the second heating element 10 passes beneath the block the wire is straightened to further reduce any effect the second heating element 10 may have on the limiter.

The first heating element 6 has, for example, a predetermined optimum operating temperature in the range of about 950° C. to about 1150° C. During the selected periods of boost heating, an operating temperature (higher than the predetermined optimum operating temperature) in the range of about 1000° C. to about 1200° C. may be arranged.

During the selected periods of normal heating, with the first heating element 6 of coiled wire in series with the second heating element 10, an operating temperature of the first heating element 6 (lower than the predetermined optimum operating temperature) in the range of about 900° C. to about 1100° C. may be arranged.

I claim:

1. A radiant electric heater arrangement for a glass-ceramic top cooking appliance, the arrangement including a heater comprising a dish-like support having supported therein a first heating element and a second heating element, wherein:

the first heating element has a predetermined minimum operating life expectancy at a predetermined optimum operating temperature;

means is provided to connect the first heating element independently to a voltage supply during user-selectable periods of boost heating in which the first heating element operates at a first temperature higher than the predetermined optimum operating temperature;

means is provided to connect the first heating element and the second heating element in series for energising from the voltage supply during user-selectable periods of normal heating, the second heating element being adapted and arranged such that, when connected in series with the first heating element, the first heating element operates at a second temperature lower than the predetermined optimum operating temperature; and means is provided for manually selecting said periods of boost heating and said periods of normal heating.

2. A heater arrangement according to claim 1, wherein the second heating element has an operating temperature which is substantially the same as the second temperature of the first heating element when operating connected in series therewith.

3. A heater arrangement according to claim 1, wherein the first heating element has substantially the same construction as the second heating element.

4. A heater arrangement according to claim 3, wherein the first heating element and the second heating element are each selected from the group consisting of a bare metallic coiled wire resistance element and a ribbon-form resistance element.

5. A heater arrangement according to claim 4, wherein the ribbon-form element is corrugated and supported edgewise in the dish-like support.

6. A heater arrangement according to claim 1, wherein the first heating element and the second heating element are permanently connected in series, means being provided for short-circuiting the second heating element during user-selected periods of boost heating.

7. A heater arrangement according to claim 6, wherein the first heating element and the second heating element comprise separate elements permanently connected in series.

8. A heater arrangement according to claim 6, wherein the first heating element and the second heating element comprise a single element having a tapping point for electrical connection.

9. A heater arrangement according to claim 1, wherein the first heating element is arranged to occupy a major proportion of the area within the dish-like support, the second heating element occupying a minor proportion thereof.

10. A heater arrangement according to claim 9, wherein the second heating element is arranged in a peripheral region of the dish-like support.

11. A heater arrangement according to claim 10, wherein the second heating element is arranged to substantially surround the first heating element.

12. A heater arrangement according to claim 1, wherein said means for manually selecting comprises a manually-adjustable cyclic energy regulator connected to the heater and arranged for connection to the voltage supply, the first heating element being arranged for connection to the voltage supply independently of the second heating element in a full power setting of the cyclic energy regulator, for selected periods of boost heating, and the first heating element and the second heating element being connected in series and for connection to the voltage supply in other settings of the cyclic energy regulator, for selected periods of normal heating.

13. A heater arrangement according to claim 12, wherein in the full power setting of the cyclic energy regulator the first heating element is energised without cycling of the voltage supply.

14. A heater arrangement according to claim 12, wherein in the other settings of the cyclic energy regulator, the first and second heating elements in series are cyclically energised from the voltage supply at selected duty cycles.

15. A heater arrangement according claim 14, wherein the selected duty cycles include 100 percent.

16. A heater arrangement according to claim 12, wherein connection of the first heating element to the voltage supply in the full power setting of the cyclic energy regulator is effected by short-circuiting the second heating element with the first and second heating elements connected in series with one another.

17. A heater arrangement according to claim 16, wherein the short-circuiting is achieved by means of switch contacts in, or associated with, the cyclic energy regulator.

18. A heater arrangement according to claim 12, wherein manual adjustment of the cyclic energy regulator is by means of a control knob rotatable by a user.

19. A heater arrangement according to claim 12, wherein the full power setting of the cyclic energy regulator, for periods of boost heating, is attainable directly from an 'OFF' setting of the cyclic energy regulator.

20. A heater arrangement according to claim 12, wherein the full power setting of the cyclic energy regulator, for periods of boost heating, is attainable from an 'OFF' setting of the cyclic energy regulator by first passing through the other settings of the cyclic energy regulator.

21. A method of operating a radiant electric heater arrangement for a glass-ceramic top cooking appliance, the arrangement including a heater comprising a dish-like support having supported therein a first heating element and a second heating element, and including means for manually selecting periods of boost heating and periods of normal heating, the first heating element having a predetermined minimum operating life expectancy at a predetermined optimum operating temperature wherein during user-selectable periods of boost heating the first heating element is connected independently to a voltage supply and operates at a first temperature higher than the predetermined optimum operating temperature; and during user-selectable periods of normal heating, the second heating element is connected to the voltage supply in series with the first heating element, the first heating element operating at a second temperature lower than the predetermined optimum operating temperature.

22. A method according to claim 21, wherein the second heating element has an operating temperature which is substantially the same as the second temperature of the first heating element when operating connected in series therewith.

23. A method according to claim 21, wherein the first heating element has substantially the same construction as the second heating element.

24. A method according to claim 23, wherein the first heating element and the second heating element are each selected from the group consisting of a bare metallic coiled wire resistance element and a ribbon-form resistance element.

25. A method according to claim 24, wherein the ribbon-form element is corrugated and supported edgewise in the dish-like support.

26. A method according to claim 21, wherein the first heating element and the second heating element are permanently connected in series, means being provided for short-circuiting the second heating element during user-selected periods of boost heating.

27. A method according to claim 26, wherein the first heating element and the second heating element comprise separate elements permanently connected in series.

28. A method according to claim 26, wherein the first heating element and the second heating element comprise a single element having a tapping point for electrical connection.

29. A method according to claim 21, wherein the first heating element is arranged to occupy a major proportion of the area within the dish-like support, the second heating element occupying a minor proportion thereof.

30. A method according to claim 29, wherein the second heating element is arranged in a peripheral region of the dish-like support.

31. A method according to claim 30, wherein the second heating element is arranged to substantially surround the first heating element.

32. A method according to claim 21, wherein said means for manually selecting comprises a manually adjustable cyclic energy regulator connected to the heater and arranged for connection to the voltage supply, the first heating element being arranged for connection to the voltage supply independently of the second heating element in a full power setting of the cyclic energy regulator, for selected periods of boost heating, and the first heating element and the second heating element being connected in series and for connection to the voltage supply in other settings of the cyclic energy regulator, for selected periods of normal heating.

33. A method according to claim 32, wherein in the full power setting of the cyclic energy regulator the first heating element is energised without cycling of the voltage supply.

34. A method according to claim 32, wherein in the other settings of the cyclic energy regulator, the first and second heating elements in series are cyclically energised from the voltage supply at selected duty cycles.

35. A method according to claim 34, wherein the selected duty cycles include 100 percent.

36. A method according to claim 32, wherein connection of the first heating element to the voltage supply in the full power setting of the cyclic energy regulator is effected by short-circuiting the second heating element with the first and second heating elements connected in series with one another.

37. A method according to claim 36, wherein the short-circuiting is achieved by means of switch contacts in, or associated with, the cyclic energy regulator.

38. A method according to claim 32, wherein manual adjustment of the cyclic energy regulator is by means of a control knob rotatable by a user.

39. A method according to claim 32, wherein the full power setting of the cyclic energy regulator, for periods of boost heating, is attainable directly from an 'OFF' setting of the cyclic energy regulator.

40. A method according to claim 32, wherein the full power setting of the cyclic energy regulator, for periods of boost heating, is attainable from an 'OFF' setting of the cyclic energy regulator by first passing through the other settings of the cyclic energy regulator.

* * * * *

UNITED STATES PATENT AND TRADEMARK OFFICE

CERTIFICATE OF CORRECTION

PATENT NO. : 5,892,206

DATED : April 6, 1999

INVENTOR(S) : GEORGE ANTHONY HIGGINS

It is certified that error appears in the above-indentified patent and that said Letters Patent is hereby corrected as shown below:

On the title page, item [73],

Assignee is "Ceramaspeed Limited."

Signed and Sealed this

Twelfth Day of October, 1999

*Attest:*

Q. TODD DICKINSON

*Attesting Officer*

*Acting Commissioner of Patents and Trademarks*